US006231174B1

(12) United States Patent
Haigo

(10) Patent No.: US 6,231,174 B1
(45) Date of Patent: May 15, 2001

(54) INK JET RECORDING DEVICE WITH INK CIRCULATING UNIT

(75) Inventor: Hideaki Haigo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/244,128

(22) Filed: Feb. 4, 1999

(30) Foreign Application Priority Data

| | | |
|---|---|---|
| Feb. 6, 1998 | (JP) | 10-025286 |
| Feb. 6, 1998 | (JP) | 10-025287 |
| Feb. 6, 1998 | (JP) | 10-025288 |
| Feb. 6, 1998 | (JP) | 10-025289 |
| May 11, 1998 | (JP) | 10-126552 |
| Jan. 14, 1999 | (JP) | 11-008199 |

(51) Int. Cl.[7] ..... B41J 2/18
(52) U.S. Cl. ..... 347/89
(58) Field of Search ..... 347/92, 85, 86, 347/87, 89, 29, 30

(56) References Cited

U.S. PATENT DOCUMENTS

| | | | | |
|---|---|---|---|---|
| 4,948,427 | * | 8/1990 | Yamagishi et al. | 106/20 |
| 5,159,348 | * | 10/1992 | Dietl et al. | 347/89 |
| 5,561,448 | | 10/1996 | Kaneko | 347/29 |
| 5,677,718 | * | 10/1997 | Crawford et al. | 347/92 |

FOREIGN PATENT DOCUMENTS

| | | | |
|---|---|---|---|
| 803362 | * | 10/1997 | (EP) . |
| 54-148534 | | 11/1979 | (JP) . |
| 56-75867 | | 6/1981 | (JP) . |
| B2-62-9427 | | 2/1987 | (JP) . |
| 4-211962 | | 8/1992 | (JP) . |

* cited by examiner

*Primary Examiner*—N. Le
*Assistant Examiner*—Michael Nghieu
(74) *Attorney, Agent, or Firm*—Oliff & Berridge, PLC

(57) ABSTRACT

An ink jet recording device includes an ink tank 21 and a print head 1 connected together by a circulation channel. The circulation channel is formed from the ink tank 21, ink supply tubes 13, 23, a manifold 11 of a print head, and ink collection tubes 16, 26. An ink circulation pump 22 is disposed along the ink supply tube 23 for performing a circulation purge, wherein ink is forcibly circulated ink through the circulation channel. During circulation purge, the rotational direction of the ink circulation pump 22 is reversed for a short period of time, so that ink flows in a direction opposite of the normal flow direction. As a result, air bubbles are loosened from where they cling on the side surfaces of the ink channel. Because the air bubbles are more easy to remove, the air bubbles are removed by flow of ink during the circulation purge. The air bubbles are transported to and collected in the ink tank, whereupon they separate from the ink due to their buoyancy.

17 Claims, 5 Drawing Sheets

INK JET RECORDING DEVICE WITH INK CIRCULATING UNIT

BACKGROUND OF THE INVENTION

1. Field of the Invention

The present invention relates to an ink jet recording device for printing by ejecting ink droplets, and more particularly to a configuration for removing air bubbles from within ink channels running between an ink tank and a print head of the ink jet recording device.

2. Description of the Related Art

Ink jet recording devices print characters and other images by ejecting droplets of ink from a print head according to an inputted signal. Ink jet recording devices eject ink droplets by pressurizing ink in the print head using various types of actuators. For example, piezoelectric elements and electrode restrictive elements can be deformed according to the inputted signal to apply pressure to ink in the print head. Also, thermal elements can be energized according to the inputted signal to selectively generate heat to boil a portion of ink in the print head. The boiled ink forms expanding bubbles that increase pressure in the ink, thereby ejecting ink droplets.

The actuators are disposed in actuator chambers of the print head. Ink is supplied to the actuator chambers through a channel defined by side walls. Sometimes, for various reasons, air bubbles cling to the side walls of the ink channel. The air bubbles can enter actuator chambers where the actuators are located. Because the bulk modulus elasticity of air is extremely small compared to that of ink, the air bubbles in the actuator chambers absorb pressure generated by the actuator, so that pressure in the actuator chamber can not be properly increased. As a result, ink droplets can not be properly ejected. When ink droplets can not be properly ejected, print quality suffers greatly.

Japanese Patent-Application Publication (Kokai) No. SHO-56-75867 discloses a circulation purge operation for preventing air bubbles from entering actuator chambers. A circulation channel is provided between an ink tank and a manifold for distributing ink to actuators in the print head. The circulation channel includes a first channel for guiding ink from the ink tank to the manifold and a second channel for returning ink from the manifold to the ink tank. During the circulation purge operation, air bubbles clinging to the inner side walls and the like of the ink channels are removed by forcibly circulating ink through the circulation channel.

SUMMARY OF THE INVENTION

Air bubbles clinging to the side walls of the circulation channel can be more effectively removed when the ink circulates through the circulation channel at a high flow velocity. However, when the flow velocity of the ink in the circulation channel is increased, the pressure of ink in the circulation channel also increases. The menisci formed in nozzles by surface tension can be disrupted so that ink can leak out of the nozzles. Therefore, ink can only be forced through the circulation channel at a slow flow velocity, which is insufficient for completely removing air bubbles.

It is an objective of the present invention to overcome the above-described problems and to provide an ink jet recording device capable of effectively removing air bubbles clinging to side walls of ink channels.

According to a first aspect of the present invention, an ink jet recording device includes a print head, a circulation channel, and an ink circulation unit. The print head has a plurality of actuators for ejecting ink to perform printing operations.

The circulation channel includes a manifold, an ink tank containing ink, a supply channel, and a collection channel. The manifold is in fluid communication with the plurality of actuators. The supply channel supplies ink from the ink tank to the manifold. The collection channel returns ink from the manifold to the ink tank.

The ink circulation unit performs circulation purge to remove bubbles from the circulation channel by changing flow direction of ink in the circulation channel.

According to the first aspect of the present invention, when circulation purge is performed, flow velocity of ink can be greatly changed by changing flow direction of ink. Air bubbles clinging to the side walls of the ink channel can be greatly loosened by this large change in flow velocity. As a result, air bubbles can be easily removed by the flow of ink. Bubbles removed by the flow of ink are collected in the ink tank and so do not enter the print head. Even though changing the flow direction of ink greatly increases the difference in the flow velocity, and so sufficiently loosens clinging air bubbles, this does not increase pressure in the ink channel as much as when air bubbles are loosened by simply increasing flow velocity of ink. As a result, ink is less likely to leak from the nozzles of the print head.

It is desirable that the ink circulation unit be provided with a reversibly rotatable ink circulation pump provided along the supply channel. With this configuration, flow direction of ink can be changed using a simple control operation of changing rotational direction of the ink circulation pump. Clinging air bubbles can be loosened by simply changing flow direction of ink in the circulation channels.

It is desirable that during circulation purge, the ink circulation unit circulate ink in a circulation direction and, for a shorter time than in the circulation direction, in a reverse direction opposite the circulation direction. With this configuration, ink bubbles removed by reversing flow of ink can be quickly removed and transported to the ink tank when the ink is circulated for a longer time in the normal circulation direction. There is no danger that the removed air bubbles will flow back to the ink channels or remain stationary in the ink channels.

According to a second aspect of the present invention an ink jet recording device includes a print head, a circulation channel, an ink circulation unit, and a vibration application unit. The print head and the circulation channel are the same as in the first aspect of the present invention.

On the other hand, the ink circulation unit performs circulation purge by circulating ink through the circulation channel. The vibration application unit applies vibration to the ink during circulation purge.

It should be noted that no particular limitations are placed on the amplitude or frequency of vibration applied by the vibration application unit. Any vibration source is sufficient as long as it is capable of vibrating the ink to shock or otherwise loosen the air bubbles clinging to the side walls of the ink channels.

According to this configuration, during circulation purge, the vibration application unit applies vibration to the circulating ink. This vibration is propagated through the ink and loosens air bubbles clinging to the side walls of the ink channels. Therefore, air bubbles can be more easily removed by flow of ink during circulation purge. Accordingly, ink bubbles are removed by flow of ink and collected in the ink tank, and so will not enter the print head. Because the air bubbles are loosened up merely by application of vibration to the circulating ink, the pressure in the ink channels need not be increased as much as when air bubbles were removed by simply increasing flow velocity of the ink. Therefore, there is less danger of ink leaking from the nozzles of the print head.

It is desirable that the vibration application unit be provided in the supply channel. With this configuration, during circulation purge, vibration can be applied to the supply channel and air bubbles can be collected by being transported to the collection channel. Therefore, very few air bubbles will be included in the ink supply to the print head. Situations wherein bubbles prevent printing can be reduced.

It is desirable that either the first or the collection channels be configured from a flexible tube and that the vibration application unit apply vibration to the flexible tube. With this configuration, ink circulating within the flexible tube is vibrated so that air bubbles clinging to the flexible tube will be loosened up, so that the air bubbles can be effectively removed from the circulation channel.

It is desirable that the ink circulation pump be provided to the flexible tube. In this case, an operation member for intermittently contacting the ink tube is desirably provided downstream from the ink circulation pump. With this configuration vibration can be applied to the ink circulating in the ink tube by vibrating ink tube.

It is desirable that the operation member includes a rotating cam member, and that the rotating cam member be rotated one or two times directly after start of circulation purge. With this configuration, vibration can be applied to the circulating ink without adversely affecting circulation of the ink.

According to third aspect of the present invention an ink jet recording device includes a print head, a circulation channel, an ink circulation unit, a capping unit, and a purge control. The circulation channel and the ink circulation unit are the same as in the second aspect of the present invention.

The print head includes a nozzle surface and a plurality of actuators. The nozzle surface is formed with a plurality of nozzles. The plurality of actuators are for ejecting ink from the plurality of nozzles to perform printing operations. The capping unit has a cap for covering the nozzle surface of the print head The purge control unit operates the circulation unit to perform circulation purge and, during circulation purge, operates the capping unit to cover the nozzle surface with the cap to form a closed space between the nozzle surface and the cap.

Because the cap of the capping unit covers the nozzle surface of the print head during circulation purge, a pressure will be applied on the nozzles of the print head. This pressure opposes the pressure of ink circulating during circulation purge. Accordingly, even if the flow velocity of ink is quite high, disruption of the ink menisci in the nozzles can be suppressed and ink leaks from the nozzles can be prevented. Therefore, the flow velocity of ink can be increased so that purge operations can be more effectively performed.

A suction purge unit can be connected to the cap so that the cap also functions as a portion of a suction purge unit for sucking ink from the print head. With this configuration, there is no need for providing a separate cap solely for forming the closed space. In this case, it is desirable that the purge control unit control the suction purge unit, during circulation purge while the cap covers the nozzle surface, to perform a suction purge for sucking ink from the print head through the cap. With this configuration, suction purge is performed by the suction purge unit during circulation purge. The synergetic effect of the circulation purge and the suction purge increases the flow velocity of ink through the circulation channel, that is from the ink tank to the supply channel, the manifold, and through the collection channel, back to the ink tank. Therefore, air bubbles clinging to the wide walls and the like of the ink channel become easy to remove. Removed air bubbles are collected then in the ink tank.

A wiper member can be provided for wiping the nozzle surface of the print head. After suction purge is performed during circulation purge, the wiper member can be used to wipe the nozzle surface of the print head. This wiping operation is the same as a wiping operation performed in a normal ink jet recording device after a normal suction purge is performed to correct defective ejection. Menisci can be properly formed by the ink in the ink nozzles by wiping using the wiping member. Therefore, print quality is not adversely affected.

It is desirable that the purge control unit control the suction purge unit to perform suction purge during circulation purge for a set time duration shorter than circulation purge. With this configuration, the suction purge unit is operated for a shorter time than during normal suction purge performed to correct defective ejection of ink. Therefore, less ink will be consumed during circulation purge so that less ink is wasted. Also, in addition to removing air bubbles from the ink channel, air bubbles clinging to the side walls of actuator chambers can be removed in the same amounts as during normal suction purge.

It is desirable that the purge control unit controls the suction purge unit to perform suction purge from start of circulation purge. With this configuration, air bubbles can be effectively removed from the overall ink channel.

It is desirable that when the cap is in fluid communication with an ink discharge channel, that an opening/closing unit be provided interlocked with the cap, so that the opening/closing unit closes the ink discharge channel when the closed space is formed between the nozzle surface and the cap. With this configuration, the closed space can be formed during circulation purge and moreover, the cap can function as a suction purge unit.

It is desirable that the purge control unit, during circulation purge, first operates the capping unit to form the closed space and then operates the suction purge unit to perform a suction purge for sucking ink from the print head. With this configuration, flow velocity of ink can be increased while maintaining the ink meniscus in the nozzles by forming the closed space. Also, the flow velocity of ink can be increased by synergistic effects of the circulation purge being performed at the same time as the suction purge. The effects of these two can facilitate removal of air bubbles clinging to the side walls of the ink channels.

It is desirable that the capping unit cover the nozzle surface with the cap during non-printing periods to prevent ink in the nozzles from drying out. With this configuration, during circulation purge, the cap forms a closed space by covering the nozzle surface of the print head in the same way as when using the suction cap to form closed space. Therefore, flow velocity of the ink can be increased and efficiency of the purge operations can be increased. In particular, because the cap for preventing ink in the ink nozzles from drying out is used to form the close space during circulation purge, there is no need to provide a separate capping unit for forming the closed space.

According to a fourth aspect of the present invention, an ink jet recording device includes a print head, a circulation channel, an ink circulation unit, a valve unit, and a purge control unit. The print head, the circulation channel, and the ink circulation unit are the same as in the third aspect of the present invention.

The valve unit is provided along the collection channel. The valve unit opens the collection channel during circulation purge and closes the collection channel during printing. The purge control unit controls the valve unit to restrict flow in the collection channel either before or after circulation purge. Also, while controlling the valve unit, purge control unit drives the ink circulation unit for a set duration of time to perform supplemental purge. It should be noted that Flow of ink in the collection channel can be restricted by completely interrupting flow of ink in the collection channel, or by merely reducing the cross sectional area of the collection channel to reduce the amount of ink flowing through the ink channels.

With this configuration, ink is circulated between the ink tank and the manifold during the circulation purge to remove air bubbles from the circulation channel. Before or after circulation purge, the purge control unit controls the valve unit to restrict flow in the collection channel. Then, a supplemental purge is performed by driving the ink circulation unit for a set duration of time. During the supplemental purge, the valve unit generates a resistance that restricts flow of the ink in the collection channel. Therefore, pressure in the circulation channel, which includes the supply channel, increases. As a result, air bubbles clinging to the side walls of the supply channel, or to the pressure chambers in the print head, are pushed out from the nozzles by flow of ink. In this case also, a wiper member can be provided for wiping the nozzle surface of the print head after the supplemental purge, in the same manner as when a suction purge is performed in the normal ink jet recording device. In this way, a proper meniscus can be formed in each nozzle so that subsequent printing performance is not adversely effected.

It is desirable that the valve unit include an open/close valve that closes the collection channel during supplemental purge. With this configuration, either before or after circulation purge, the opening/closing valve blocks the collection channel. Therefore, when the ink circulation unit is driven for set a duration of time during the supplemental purge, pressure in the supply channel can be effectively increased.

It is desirable to provide a capping unit having a cap which can be brought into confrontation with the nozzle surface of the print head. In this case, the purge control unit drives the capping unit to move the cap into confrontation with the nozzle surface when performing the supplemental purge. With this configuration, before or after circulation purge, ink pushed out of the nozzles with the air bubbles during the supplemental purge is received in the cap so that the area around the print head is not stained with ink.

It is desirable that the capping unit includes a pump for sucking ink out from the cap. In this case, the control unit drives the pump in addition to driving the ink circulation unit during supplemental purge. With this configuration, ink can be removed from the cap. It should be noted that the pump need only be driven to remove ink from the cap. There is no need to normally drive the pump when driving the ink circulation unit.

Alternatively, when the capping unit is provided with a pump for sucking ink from the cap, the purge control unit can drive the pump after driving the ink circulation unit for a supplemental purge. With this configuration, pressure in the supply channel can be increased and air bubbles clinging to the side walls of the ink channels can be easily removed and pushed out through the nozzles of the ink head. Afterward, the pump is driven to remove ink from the cap. Here, the pump need only be driven so that ink is removed from the cap only directly before completion of the supplemental purge.

It is desirable that the capping unit cover the nozzle surface with the cap during non-printing periods to prevent ink in the nozzles from drying out. With this configuration, there is no need to provide a separate cap unit for performing supplemental purge.

According to a fifth aspect of the present invention, an ink jet recording device includes a print head, a circulation channel, an ink circulation unit, and a valve unit. The print head, the circulation channel, and the ink circulation unit are the same as in the fourth aspect of the present invention.

On the other hand, the valve unit provided along the collection channel restricts flow in the collection channel during circulation purge and closes the collection channel during printing.

With this configuration, during circulation purge, air bubbles are removed from the circulation channel by circulating ink between the ink tank and manifold. In addition, during circulation purge the valve unit temporarily restricts flow of ink in the collection channel to increase pressure in the ink channel. Ink bubbles clinging to the side walls of the ink channel and of the pressure chambers in the print head are pushed out of the nozzles along with ink. It should be noted that when printing is performed, the valve unit blocks off the collection channel so that ink is supplied through the supply channel. As a result, the printing function is not disrupted.

BRIEF DESCRIPTION OF THE DRAWINGS

The above and other objects, features and advantages of the invention will become more apparent from reading the following description of the preferred embodiment taken in connection with he accompanying drawings in which.

DETAILED DESCRIPTION OF THE PREFERRED EMBODIMENTS

Figure 1A:
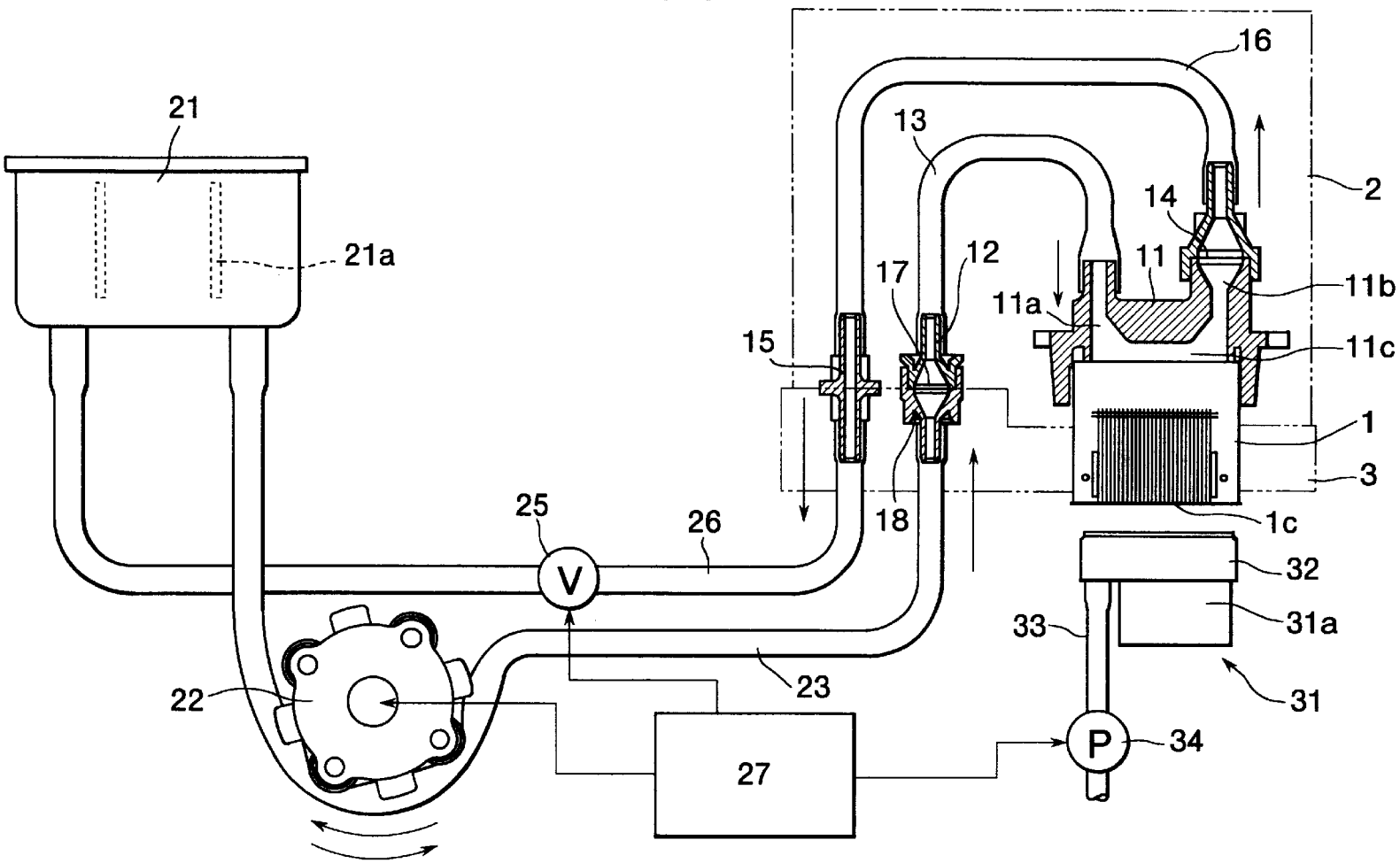
FIG. 1(A) is a schematic view showing an ink jet recording device according to a first, third, and sixth embodiments of the present invention.

Ink jet recording devices according to embodiments of the present invention will be described while referring to the accompanying drawings wherein like parts and components are designated by the same reference numerals to avoid duplicating description.

FIG. 1(A) is a schematic view showing an ink jet recording device according to a first embodiment of the present invention. As shown in FIG. 1(A), a head unit 2 including a print head 1 is mounted on a carriage 3. Operation of the print head 1 and the carriage 3 is controlled by a microcomputer not shown in the drawings. During print operations, the carriage 3 is reciprocally scanned across the surface of a print medium, such as a paper sheet, within a print area for printing characters and the like. In between printing operations, the carriage 3 is moved to a recovery area, which is outside of the print area.

Figure 1B:
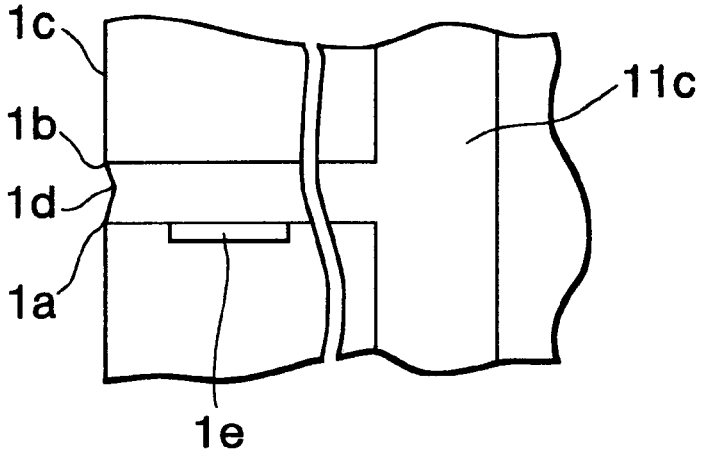
FIG. 1(B) is a partial cross-sectional view showing an exemplary head of the ink jet recording device of the present invention.

As shown in FIG. 1(A), the print head 1 includes a plurality of pressure chambers 1*a* in the same manner as a normal print head. As shown in FIG. 1(B), each pressure chamber 1*a* is in fluid connection with a corresponding nozzle 1*b* and with a common holding portion 11*c* of a manifold 11 to be described later. The nozzles are formed in a nozzle surface 1*c*, which faces downward as shown in FIG. 1(A). Each pressure chamber 1*a* is filled with ink supplied from the holding portion 11*c* so that a meniscus 1*d* forms in the nozzle 1*b*.

Each pressure chamber 1*a* is provided with an actuator 1*e*. Ink droplets are ejected from the print head 1 by selectively applying energy to the actuators 1*e* based on print data. A variety of conventional actuators can be used as the actuators 1*e*. For example, piezoelectric elements and electrorestrictive elements can be used to apply pressure to ink in the pressure chambers 1*a* by deformation. Also, thermal elements can be used to selectively generate heat to boil a portion of ink in the print head 1. The boiled ink forms expanding bubbles that increase pressure in the ink, thereby ejecting ink droplets.

As shown in FIG. 1(A), the head unit 2 includes the manifold 11, a head-side ink supply tube 13, and a head-side ink collection tube 16. The manifold 11 is adhered to an upper surface of the print head 1. The holding portion 11*c* of the manifold 11 is provided in fluid communication with all the actuator pressure chambers 1*a* of the print head 1. The manifold 11 is also formed with an ink inflow port 11*a* and an ink outflow port 11*b*, which are both in fluid communication with the holding portion 11*c*, from opposite ends of the holding portion 11*c*. A filter member 14 for entrapping foreign matter in ink is provided to the ink outflow port 11*b*. A filter 17 for entrapping foreign matter in ink is provided to the joint member 12.

The head-side ink supply tube 13 is attached to one end to the ink inflow port 11*a* of the manifold 11. A joint member 12 is provided to the other end of the head-side ink supply tube 13. The head-side ink collection tube 16 is connected at one end to the ink outflow port 11*b* of the manifold 11. A joint member 15 is provided to the other end of the head-side ink collection tube 16.

The carriage 3 is provided with a joint reception member 18, which is detachably connected to the joint member 12. A tank-side ink supply tube 23 is connected at one end to the joint reception member 18 and the other end to an ink tank 21. The tank-side ink supply tube 23 is formed from a flexible material. A ink circulation pump 22 capable of forward and reverse rotation is provided along the tank-side ink supply tube 23. A tank-side ink collection tube 26 is connected at one end to the joint member 15 and at the other end to the ink tank 23. The tank-side ink collection tube 26 could be formed from a stiff material or from a flexible material. An opening/closing valve 25 is provided along the tube 26.

According to the present embodiment and as shown in FIG. 1(A), the ink circulation pump 22 includes a plurality of rollers that serve as pressing members. As the pump 22 rotates, the rollers squeeze the tube 23 one after the other following the lengthwise dimension of the tube 23, so that ink is pressed to flow within the tube 23. It should be noted that the ink circulation pump 22 can be any type of pump capable of producing ink flow in the tube 23. The opening/closing valve 25 can be operated to open and close using a motor, an electromagnet, or some other configuration. The opening/closing valve 25 is closed during normal printing and is opened when the ink circulation pump 22 is driven.

The ink tank 21 is formed with openings on its bottom surface at positions separated from each other. The tank-side tubes 23, 26 are connected to the ink tank 21, one to each opening. A plurality of partitions 21*a* are provided within the ink tank 21 between the openings for the ink side tubes 23, 26. With this configuration, ink from the tank-side ink collection tube 26 enters the ink tank 21, snakes around the partitions 21*a*, and enters the second tank side ink tube 23. At this time, air bubbles held in the ink are separated from the ink by their own buoyancy. The ink tank is opened to atmosphere at its upper end so that air bubbles separated from the ink are released to atmosphere through the open upper end of the ink tank 21.

A suction purge unit 31 for sucking ink from the nozzles 1*b* of the print head 1 is provided in the recovery area, which, as mentioned previously, is to the side to the print area. The suction purge unit 31 includes a suction cap 32, a suction pump 34, and a cap movement unit 31*a*. The suction cap 32 and the suction pump 34 are connected together through a suction pipe 33. The cap movement unit 31*a* is a well-known unit for moving the suction cap 32 to cover the nozzle surface 1*c* of the print head 1 and moving the cap 32 away from the nozzle surface 1*c*. The suction purge unit 31 performs purge operations by covering the nozzle surface 1*c* with the suction cap 32 and operating the pump 34 to suck ink from the nozzles 1*b* through the cap 32.

A purge control unit 27 formed from a microcomputer is connected to the ink circulation pump 22, the opening/closing valve 25, and the suction purge unit 31. The purge control unit 27 controls the ink circulation pump 22, the opening/closing valve 25, and the suction purge unit 31 in order to remove air bubbles from ink and ensure good conditions for proper ejection of ink.

When the print head 1 is to be filled with ink, the purge control unit 27 controls the cap movement unit 31*a* to move the suction cap 32 toward the print head 1 so that the suction cap 32 covers the print head 1. The purge control unit 27 also controls the opening/closing valve 25 to open and drives rotation of the ink circulation pump 22. As a result, the ink circulation pump 22 forces ink from the ink tank 21, through the tank-side ink supply tube 23 and the head-side ink supply tube 13, into the holding portion 11*c* of the manifold 11. At the same time, ink in the holding portion 11*c* is returned to the ink tank 21 through the head-side ink collection tube 16 and the tank-side ink collection tube 23.

Afterward, the opening/closing valve 25 is driven closed and the ink circulation pump 22 is stopped in an orientation where none of the pressing members squeeze the tank-side ink supply tube 23 closed. Next, the suction pump 34 is driven to develop a negative pressure in the cap 32. As a result, ink in the holding portion 11*c* is sucked through the pressure chambers 1*a* and into the suction cap 32, so that the pressure chambers 1*a* are filled up with ink. During printing operations, ejection of ink from the print head 1 lowers pressure in the holding portion 11*c*, so that ink is supplied from the ink tank 21, through the tank-side ink supply tube 23 and the head-side ink supply tube 13, and to the holding portion 11*c*.

A circulation channel is configured from the ink tank 21, the tank-side ink supply tube 23, the head-side ink supply tube 13, the holding portion 11*c* of the manifold 11, the head-side ink collection tube 16, and the tank-side ink collection tube 26. Air bubbles clinging to the side walls and the like of the circulation channel can be removed by forcing ink to flow through the circulation channel in a circulation purge operation.

During circulation purge, the purge control unit 27 controls the opening/closing valve 25 to open and controls drive of the ink circulation pump 22 so that ink is supplied from the ink tank 21, through the tank-side ink supply tube 23 and the head-side ink supply tube 13, and to the holding portion 11*c* of the manifold 11. It should be noted that the tank-side ink supply tube 23 and the head-side ink supply tube 13 configure a supply channel. At the same time, ink is returned from the holding portion 11*c*, through the head-side ink collection tube 16 and the tank-side ink collection tube 26, and collected in the ink tank 21. It should be noted that the head-side ink collection tube 16 and the tank-side ink collection tube 26 configure a collection channel. While ink collected in the ink tank 21 snakes around the partitions 21*a*, air bubbles included in the ink float up and are released to atmosphere. As a result, ink with very few air bubbles is supplied to the print head 1 through the tank-side ink supply tube 23.

During circulation purge, the rotation direction of each ink circulation pump 22 is reversed for a duration of time that is shorter than it is driven forward. As a result, the direction of ink flow changes so that air bubbles clinging to side walls and the like in the ink tubes 23, 13, 16, 26 are shaken up and loosened. As a result, air bubbles can be easily removed by flow of the ink. This control of the flow direction of ink is performed by the purge control unit 27 controlling the rotational direction of the ink circulation pump 22.

For example, the ink circulation pump 22 could rotate at a speed of twenty times per minute. The purge control unit 27 could control the ink circulation pump 22 to rotate twenty times in the direction for normal ink supply, that is, counterclockwise as viewed in FIG. 1(A). Then, the purge control unit 27 controls the ink circulation pump 22 to rotate one time in the opposite direction, and then twenty times in the forward direction. This pattern of twenty turns forward and one turn reverse can be repeated as needed.

When the flow of ink is changed to the direction opposite the normal flow direction, the flow velocity of ink in the circulation channel changes greatly. As a result, air bubbles clinging to the inner surfaces of the tubes 13, 16, 23, 26 are loosened and so can be easily removed by flow of ink. Since the flow of ink is changed in the reverse direction only for a short duration of time, bubbles removed by flow of ink will not flow backward or remain stationary in the ink channel, but instead will be quickly carried to the ink tank 21 through the collection channels 16, 26.

In particular, because the direction of ink flow is changed using the ink circulation pump 22, which is provided along the tank-side ink supply tube 23, air bubbles near the circulation pump 22, for example, air bubbles that cling to side surfaces of the tank-side ink supply tube 23 and the head-side ink supply tube 13, can be effectively loosened, so they can be easily removed by flow of ink. Because the ink circulation pump 22 is used, this configuration is beneficial for removing air bubbles clinging to the inner surface of the tubes 13, 23 that supply ink to the print head 1.

Because the flow velocity of the ink is greatly changed by changing flow direction of the ink, the pressure in the ink tubes 13, 16, 23, 26 will not greatly increase. As a result, ink menisci formed in the nozzles of the print head 1 will not be disturbed and ink will be unlikely to leak out from the nozzles.

According to the present embodiment, the suction purge unit 31 removes air bubbles from the pressure chambers 1*a* by sucking ink from the pressure chambers 1*a* while the suction cap 32 is in the intimate contact with the nozzle surface 1*c*. This suction purge can either be performed independently from the circulation purge or, in the manner to be described later, in association with the circulation purge.

Figure 2:
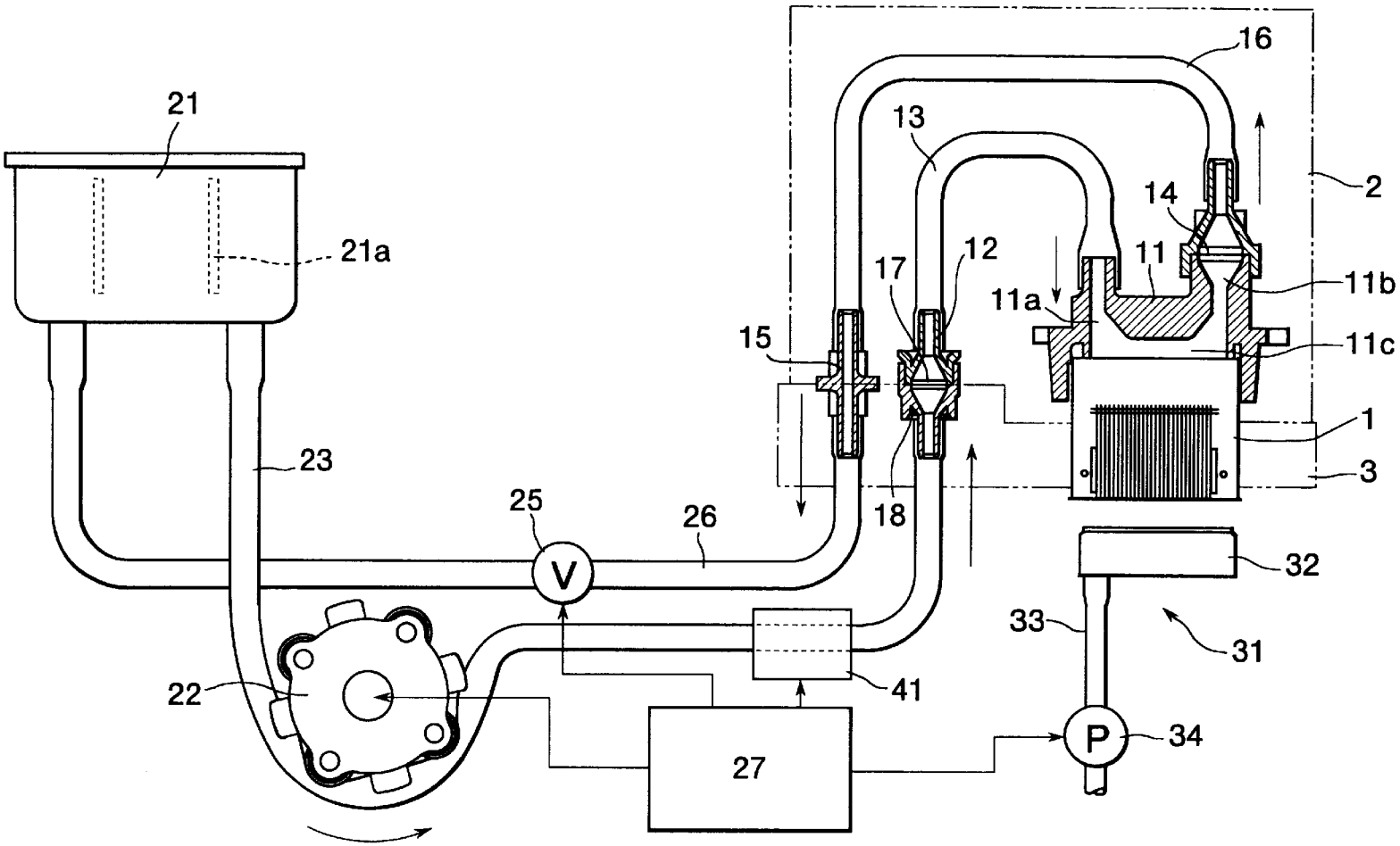
FIG. 2 is a schematic view showing an ink jet recording device according to a second embodiment of the present invention.
Figure 3:
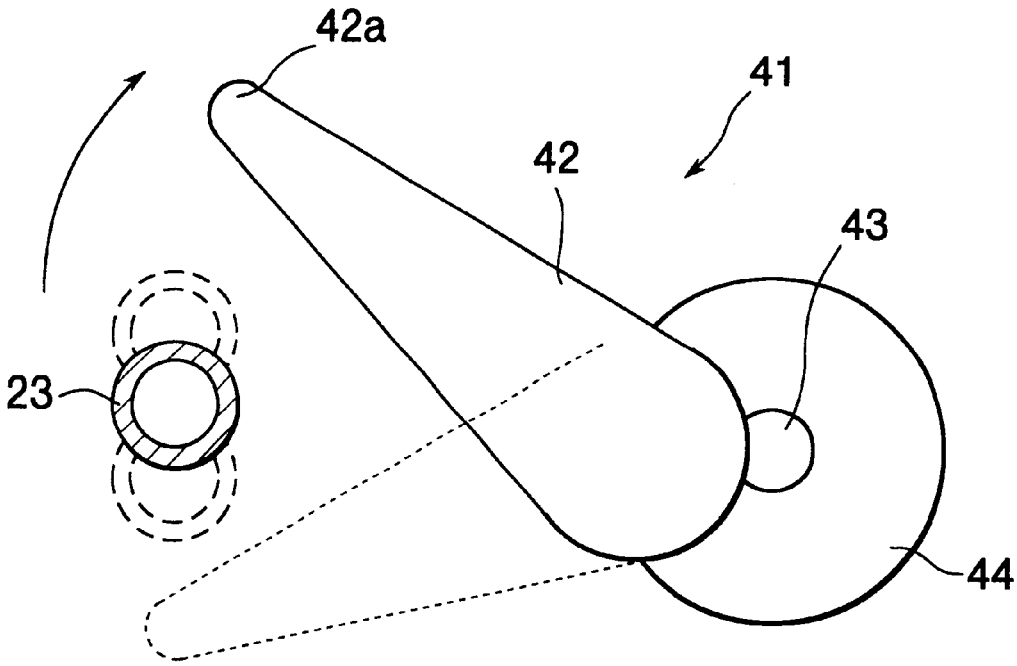
FIG. 3 is a magnified view showing a vibration application unit according to the second embodiment.

Next, an ink jet recording device according to a second embodiment of the present invention will be provided while referring to FIGS. 2 and 3. The ink jet recording device of the second embodiment is similar to the ink jet recording device of the first embodiment. However, according to the second embodiment, a vibration application unit 41 for vibrating the circulating ink is provided along the tank-side ink supply tube 23 at a position downstream from the ink circulation pump 22.

As shown in FIG. 3, the vibration application unit 41 includes a cam member 42, a pinion member 43, and a step motor 44. The cam member 42 serves as an operation member and has an abutment portion 42*a* for tapping against the tank-side ink supply tube 23. The pinion member 43 is in meshing engagement with a gear portion (not shown) provided integrally with the cam member 42. The step motor 44 serves as a drive unit for driving rotation of the pinion member 43.

The tank-side ink supply tube 23 is formed from a flexible material, so it can be easily vibrated by tapping contact with the pinion member 43. The vibration application unit 41 applies vibration to the tank-side ink supply tube 23 by intermittently tapping the tank-side ink supply tube 23 using the abutment portion 42*a*. After start of circulation purge, which lasts a total of about one minute, the purge control unit 27 controls drive of the step motor 44 to rotate the cam member 42 one or two times. As a result, the abutment portion 42*a* taps against the tube 23 and vibration is applied to the circulating ink.

Circulation purge is performed in a manner similar to that described for the first embodiment. That is, the opening/closing valve 25 is opened and the ink circulation pump 22 is driven to forcibly circulate ink through the circulation channel formed from the ink tank 21, the tank-side ink supply tube 23, the head-side ink supply tube 13, the holding portion 11*c* of the manifold 11, the head-side ink collection tube 16, and the tank-side ink collection tube 26. During circulation purge, the cam member 42 intermittently contacts the flexible ink tube 23 at a position downstream from the ink circulation pump 22. As a result, the tank-side ink supply tube 23 vibrates, so that air bubbles clinging to the inner surfaces of the tank-side ink supply tube 23 are loosened and easily removed by flow of ink. Air bubbles removed from flow of ink in this manner are collected in the ink tank 21 with the flow of ink and separate from the ink by heir own buoyancy.

Because vibration is applied to the tank-side ink supply tube 23, air bubbles clinging to the inner surfaces of the tank-side ink supply tube 23 and the head-side ink supply tube 13 can be effectively shaken up and loosened, so they can be easily removed. That is, by applying vibration at a position downstream from the ink circulation pump 22, air bubbles clinging to the inner surfaces of the ink tubes 13, 23 can be effectively removed and collected through the ink tubes 16, 26. As a result, ink supplied to the print head 1 during printing has very few air bubbles, so that poor printing relating to presence of air bubbles in the ink can be prevented.

Because air bubbles are loosened by applying vibration to the circulating ink, pressure in the ink channel does not greatly increase. Therefore, ink menisci formed in the nozzles of the print head 1 will not be disturbed so that ink is unlikely to leak from the nozzles.

According to the second embodiment, the vibration application unit 41 applies vibration by driving the cam member 42 by rotation of the step motor 44. However, other configurations can be used for applying vibration. For example, a cam member can be pivoted within a set angular range. This configuration requires less space than when the cam member is rotated. As a result, the ink jet recording device can be smaller. Alternatively, there is no need to provide a cam member. For example, a protrusion or other abutment portion can be provided on the carriage. The carriage can be driven to move so that the abutment portion taps against the ink tube to apply vibration. Further, any commercially available vibrator can be used.

Although the second embodiment describes vibration application unit 41 as being provided along the supply tube 23 at a position downstream from the ink circulation pump 22, a vibration application unit could instead be provided anywhere along the circulation channel. For example, the vibration application unit could be provided along the collection tube 26. In this case, it is desirable that the collection tube 26 be formed from a flexible material. The vibration application unit could alternatively be provided along the supply tube 23 at a position upstream from the ink circulation pump 22.

Next, an ink jet printer according to a third embodiment of the present invention will be described. The device according to the third embodiment has the same configuration as the device according to the first embodiment. However, according to the third embodiment, the purge control unit 27 controls to perform a suction purge at the same time as circulation purge.

In between printing operations, the carriage 3 is moved from the printing area to the recovery area. In this condition, circulation purge is performed in the same manner as in the previous embodiments, wherein the purge control unit 27 opens the opening/closing valve 25 and drives the ink circulation pump 22 to rotate, so that ink in the ink tank 21 is forced through the tank-side ink supply tube 23, the head-side ink supply tube 13, the holding portion 11*c* of the manifold 11, the head-side ink collection tube 16, and the tank-side ink collection tube 26, and back into the ink tank 21. Air bubbles clinging to the side surfaces of the tubes are carried with flow of ink into the ink tank 21 and separated from the ink by their own buoyancy.

In addition, the purge control unit 27 controls drive of the suction purge unit 31 to perform a suction purge operation for a set duration of time from the start of circulation purge. As a result, a suction purge operation is performed in addition to the circulation purge. That is, simultaneously with start of circulation purge, the purge control unit 27 drives the cap movement unit 31*a* to move the suction cap 32 to cover the nozzle surface of the print head 1. In this condition, the suction pump 34 is driven to suck ink and air bubbles from the print head through the suction cap 32. After the set duration of time elapses, the drive of the suction pump 34 is stopped and the suction cap 32 is retracted away from the nozzle surface of the print head 1. In this way, the purge control unit 27 controls to perform a suction purge operation for a set duration of time from start of circulation purge. Therefore, air bubbles are removed not only from the circulation channel, but also from the pressure chambers of the print head. Also, the synergistic effects of performing both the circulation purge and suction purge at the same time, increases flow velocity of ink in the ink supply tubes 23, 13. This increase in the flow velocity of the ink facilitates the removal of air bubbles clinging to the side surfaces of the ink tubes 13, 23. As a result, air bubbles clinging to the inner surfaces of the head-side ink supply tube 13 and the tank-side ink supply tube 23 are prevented from being supplied to the print head 1 so that proper printing conditions can be assured.

When the carriage 3 returns to the print area, then a wiper member (not shown) wipes the nozzle surface of the print head 1 to form ink menisci within the nozzles of the print head 1. This wiping operation is similar to that performed after a normal suction purge operation for correcting defective ejection of ink.

Because the suction purge unit 31 is driven to perform suction purge for only a set duration of time from start of the circulation purge, only a small amount of ink is sucked out from the print head 1 compared to the amount of ink sucked out during a normal suction purge. Therefore, no ink is wasted by performing the suction purge operation at the same time as the circulation purge. Also, flow velocity of ink is increased by the suction purge at the start of circulation purge, so that air bubbles are removed at an early stage of the circulation purge. As a result, time required for removing air bubbles can be shortened overall.

According to the third embodiment, the same suction purge unit used for performing normal suction purge is also used for performing suction purge during circulation purge. However, the present invention is not limited to such a configuration. For example, a separate suction purge unit used exclusively for suction purge during circulation purge can be provided separately from the suction purge unit for performing normal suction purge.

Figure 4:
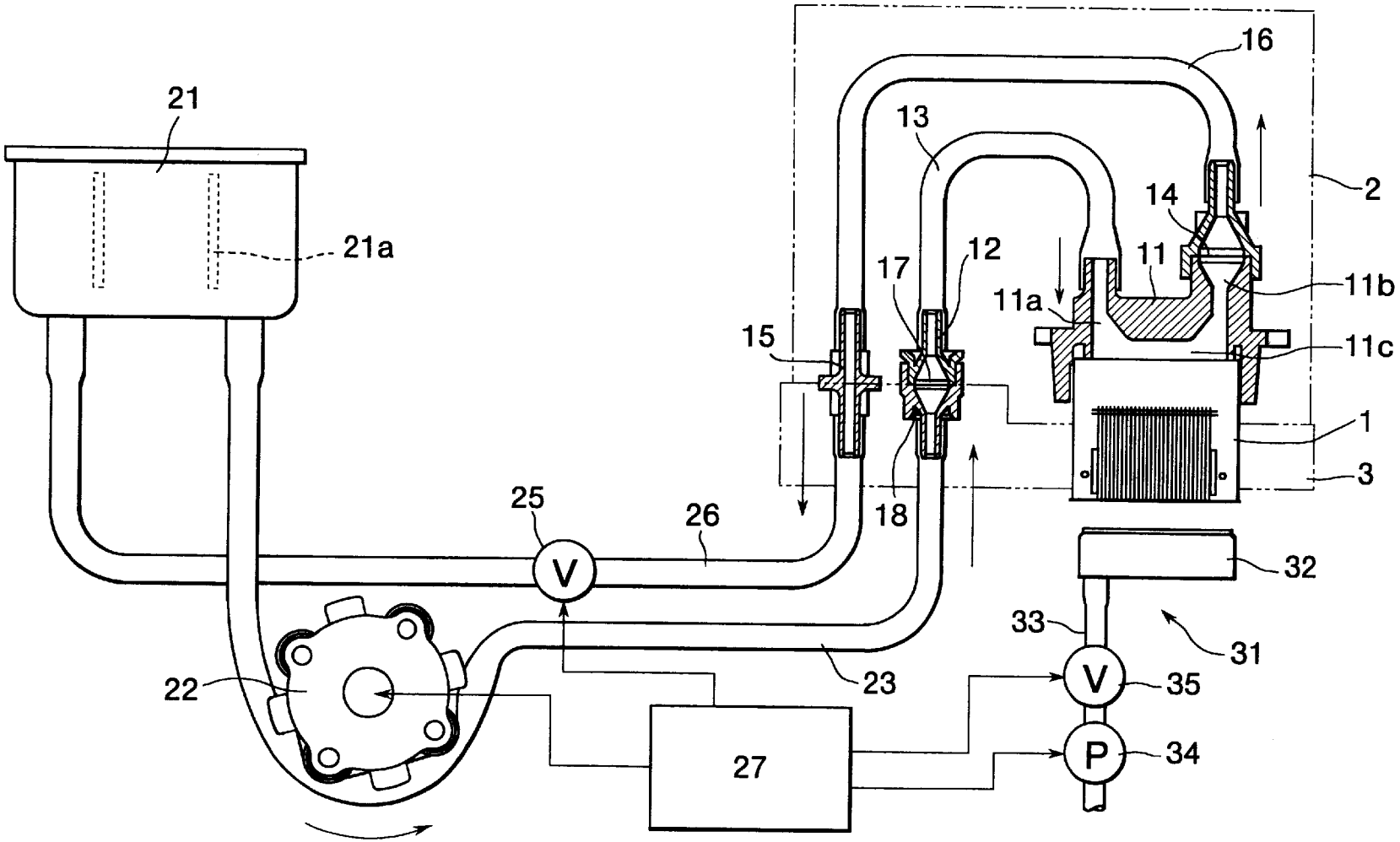
FIG. 4 is a schematic view showing an ink jet recording device according to a fourth embodiment of the present invention.

Next, an ink jet recording device according to a fourth embodiment of the present invention will be described while referring to FIG. 4. According to the fourth embodiment, before circulation purge is started, a closed space is formed between the nozzle surface 1*c* and the suction cap 32 so that flow velocity of ink during circulation purge can be increased without the accompanying increase in pressure adversely affecting the menisci in the nozzles 1*b*.

The configuration according to the fourth embodiment is similar to the configuration of the first embodiment. In addition, a valve 35 serving as an opening/closing unit is provided along the pipe 33 of the suction purge unit 31. The suction purge unit 31 and the opening/closing valve 35 are connected to the purge control unit 27, as are the ink circulation pump 22 and the opening/closing valve 25. The purge control unit 27 executes normal purge operations performed to correct defective ejection of ink. In addition, during circulation purge performed to remove air bubbles from the circulation channel, the purge control unit 27 controls to cover the nozzle surface 1*c* with the suction cap 32 and to close the opening/closing valve 35 in order to form a closed space between the suction cap 32 and the nozzle surface. The pipe 33 serves as an ink discharge channel in fluid communication with the cap 32. The valve 35 closes off the ink discharge channel during circulation purge.

When filling the print head 1 with ink and when sucking ink from the pressure chambers 1*a* of the print head 1 as described during the first embodiment, the purge control unit 27 controls the opening/closing valve 35 to open so that negative pressure generated by the suction pump 34 will be communicated to the suction cap 32. When circulation purge is performed to remove air bubbles clinging to surfaces of the ink tubes 13, 23, 16, and 26 (especially, from surfaces of the ink supply side ink tubes 13, 23), first, printing is temporarily stopped and the carriage 3 is moved from the print area to the recovery area. The purge control unit 27 controls the opening/closing valve 25 to open and controls drive of the ink circulation pump 22. As a result, ink is forced from the ink tank 21 through the tank-side ink supply tube 23, the head-side ink supply tube 13, the holding portion 11*c*, the head-side ink collection tube 16, and the tank-side ink collection tube 26, and back to the ink tank 21. As a result, air bubbles clinging to the side surfaces of the ink tubes are carried to the ink tank 21 along with ink and removed from the ink.

In addition, during circulation purge, the purge control unit 27 controls the suction purge unit 31 to cover the nozzle surface of the print head 1 with the suction cap 32 and controls the opening/closing valve 35 to close. As a result, a closed space is formed between the nozzle surface and the suction cap 32. The opening/closing valve 35 is desirably closed either simultaneously with, or directly after, a closed space between the nozzle surface 1*c* and the cap 32 is formed, so that air in the suction cap 32 is not pushed into the nozzles 1*b* by the suction cap 32 moving toward the nozzle surface 1*c*.

When the closed space is formed between the nozzle surface 1*c* and the cap 32 in this manner, flow velocity of ink in the circulation channel can be increased sufficiently high to easily remove air bubbles clinging to the inner surfaces of the ink tubes 13, 23, 16, 26, without disrupting the ink menisci 1*d* in the nozzles 1*b*. This is because air in the closed space resists pressure caused by the quickly flowing ink. Also, ink will not leak out of the nozzles. When the suction cap 32 is formed from a well-known resilient material, such as rubber, the suction cap 32 will compress by abutting with the nozzle surface with only a small force. The pressure in the closed space will rise only slightly as a result. The flow velocity of ink in the circulation channel can be increased even greater without fear of disturbing the menisci id in the nozzles 1*b*.

After circulation purge, the carriage 3 returns to the print area. At this time, there is no need to wipe the nozzle surface of the print head 1 using a wiper member (not shown in the drawings). This differs from normal suction purge performed for correcting defective ejection of ink.

Air bubbles clinging to the surfaces of the head-side ink supply tube 13 and the tank-side ink supply tube 23 are prevented from being supplied to the print head 1 so that proper printing can be performed.

Also, according to the fourth embodiment, suction purge is not performed during circulation purge. Instead, the suction cap 32 merely covers the nozzle surface of the print head 1. As a result, ink is not wasted to remove air bubbles.

Figure 1C:
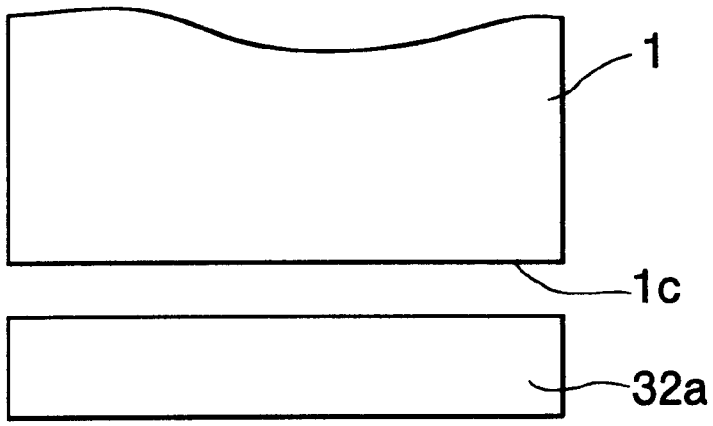
FIG. 1(C) is a plan view showing a maintenance cap for covering the head to prevent ink in nozzles from dyring out.

Next, an ink jet recording device according to a fifth embodiment of the present invention will be described. As shown in FIG. 1(C), a maintenance cap 32*a* is used to form the closed space with the nozzle surface 1*c* of the print head 1. The maintenance cap 32*a* is for intimately contacting the nozzle surface 1*c* of the print head 1 to prevent ink in the nozzles 1*b* from drying out. Therefore, the maintenance cap 32*a* is a suitable component for forming the closed space without air leaks. In other words, the ink jet recording device of the fifth embodiment is similar to that of the fourth embodiment, but the suction cap 32 is replaced with the maintenance cap 32*a*. Also, the suction pump 34, the opening/closing valve 35, and the suction pipe 33 of the fourth embodiment are dispensed with. As a result, operations during circulation purge are substantially the same as for the fourth embodiment, only that the control of the opening/closing valve 35 is eliminated.

Next, an ink jet recording device according to a sixth embodiment of the present invention will be described. In the sixth embodiment, pressure in the circulation channel is increased in a supplementary purge to be described later. Air bubbles clinging to the side surfaces of the supply channel and the pressure chambers of the print head are flushed out of the nozzles of the print head along with ink. The configuration of the sixth embodiment is the same as that shown in FIG. 1 for the first embodiment.

The suction purge unit 31 of the sixth embodiment is used connected to the purge control unit 27. The suction purge unit 31 performs suction purges for correcting defective ejection of ink and also performs the supplemental purge mentioned above. During normal suction purge and supplemental purge, the suction purge unit 31 receives ink from the nozzles of the print head 1 and functions to discharge the received ink.

Before or after circulation purge is performed, the opening/closing valve 25 is closed and the ink circulation pump 22 is driven to perform a supplemental purge. As a result, pressure in the ink tubes 13, 23 increases and air bubbles clinging to the inner surfaces of the ink channels are easy to remove. Removed air bubbles are pushed out through the nozzles in the print head 1. Before performing the supplemental purge, the suction purge unit 31 is driven to either bring the suction cap 32 into intimate contact with the nozzle surface 1*c*, or merely into confrontation with the nozzle surface 1*c*. As a result, ink flushed out of the nozzles 1*b* is received in the suction cap 32 so that ink can be prevented from staining surrounding areas.

Operations for filling the print head 1 with ink and for performing suction purge to suck ink from the pressure chambers 1*a* in the print head 1 are performed in the same manner as described for the first embodiment. That is, the carriage 3 is moved from the print area to the recovery area in between printing operations. In this condition, a circulation purge is performed in the same manner as described in the first embodiment, so that ink is circulated through the circulation channel to carry air bubbles along with ink to the ink tank 21, where the air bubbles are removed.

In addition to this, either before or after circulation purge, the opening/closing valve 25 blocks the tank-side ink collection tube 26. In this condition, the ink circulation pump 22 is driven for a set duration of time to perform supplemental purge. By performing this supplemental purge, pressure in the head-side ink supply tube 13 and the tank-side ink supply tube 23 increases, so that air bubbles clinging to the side surfaces of the tubes 13, 23 are removed more easily than during circulation purge. As a result, air bubbles clinging to the surfaces of the ink channel and the pressure chambers are pushed out the nozzles in the print head 1 along with ink. At this time, the nozzle surface of the print head 1 is covered by the suction cap 32 and the suction pump 34 is driven to discharge ink from the suction cap 32, so that ink flushed out of the nozzles 1*b* is removed from within the suction cap 32 and discharged out through the suction pipe 33.

The synergistic effect of the circulation purge and the supplemental purge effectively removes air bubbles clinging to the pressure chambers 1*a*, the holding portion 11*c* of the manifold 11, and the inner surfaces of the tank-side ink supply tube 23 and the head-side ink supply tube 13. Air bubbles are prevented from blocking the pressure chambers 1*a* in the print head 1 and from absorbing pressure generated by actuators 1*e*. As a result, proper ejection of ink droplets can be assured.

It should be noted that supplemental purge can be repeated by being performed both before and after circulation purge. Also, circulation purge can be repeated. That is, a supplemental purge can be performed after a circulation purge and then a circulation purge can again be performed.

According to the sixth embodiment, to perform a supplemental purge, the opening/closing valve is driven to completely block the collection channel. However, the present invention is not limited to this configuration. Air bubbles become easier to separate from the side surfaces of the ink channel when pressure in the ink channel increases. Therefore a valve circuit having a restricting aperture can be used instead of the opening/closing valve. With this configuration when the supplemental purge or circulation purge is performed the valve restricts the flow of ink in the collection channel so that pressure in the ink channel can be increased. The valve circuit needs to be controlled to open during normal printing. This is to prevent the collection channel from being blocked during normal printing so that printing operations are not disrupted.

According to the sixth embodiment, a normal suction purge unit for performing normal suction purges is used as a capping unit. However, the present invention is not limited to this embodiment. For example, there is no need for the capping unit to perform positive suction operations as long as the capping unit is capable of preventing the flushed out ink from staining surrounding areas. A special capping unit, for capping the nozzle surface of the print head during supplemental purge, can be provided separately from the cap for normal suction purge. Alternatively, the maintenance cap can be used for capping the nozzle surface of the print head during supplemental purge. As mentioned previously, the maintenance cap is for covering the nozzle surface after print operations are completed or in between print operations to prevent ink in the nozzles from drying. When the maintenance cap is used, also, a pump for discharging ink from the cap can be provided. In this case, after the circulation pump is driven a predetermined duration of time, the pump is driven to discharge ink that has leaked into the cap. As a result, the cap is used to discharge ink. A porous member or a container of some type can be alternatively provided to directly receive ink flushed out of the nozzles.

It should be noted that each of the embodiments, the present invention is applied to an ink Jet recording device for printing on a print medium by reciprocally transporting a carriage in front of the print medium. However, the present invention is not limited to this configuration and can be applied to ink jet recording devices that do not have a carriage that moves with respect to a print medium.

Also, the ink tank 21 can be connected to a main tank having a large capacity for supplying ink to the ink tank 21 when ink in the ink tank 21 drops below a certain level.

Also, all of the different embodiments can be mixed together as desired in a variety of different combinations.

What is claimed is:

1. An ink jet recording device, comprising:

a print head having a plurality of actuators for ejecting ink to perform printing operations;

a circulation channel including:

a manifold in fluid communication with the plurality of actuators;

an ink tank containing ink;

a supply channel that supplies ink from the ink tank to the manifold; and a collection channel that returns ink from the manifold to the ink tank; and an ink circulation unit that performs circulation purge to remove bubbles from the circulation channel by changing flow direction of ink in the circulation channel.

2. The ink jet recording device as claimed in claim 1, wherein the ink circulation unit includes a reversibly rotatable ink circulation pump provided along the supply channel.

3. The ink jet recording device as claimed in claim 1, wherein during circulation purge, the ink circulation unit circulates ink in a circulation direction and, for a shorter time than in the circulation direction, in a reverse direction opposite the circulation direction.

4. An ink jet recording device, comprising:

a print head having a plurality of actuators for ejecting ink to perform printing operations;

a circulation channel including:

a manifold in communication with the plurality of actuators;

an ink tank containing ink;

a supply channel that supplies ink from the ink tank to the manifold; and a collection channel that returns ink from the manifold to the ink tank; and wherein one of the supply and collection channels includes a flexible ink tube;

an ink circulation unit that performs circulation purge to remove bubbles from the circulation channel by circulating ink through the circulation channel;

a vibration application unit for applying vibration to the ink during circulation purge by vibrating the flexible ink tube; and an ink circulation pump provided along the flexible ink tube, wherein the vibration application unit includes a member provided downstream from the ink circulation pump in a circulation flow direction, the operation member intermittently contacting the flexible ink tube.

5. An ink jet recording device as claimed in claim 4, wherein the vibration application unit is provided along the supply channel.

6. An ink jet recording device as claimed in claim 4, wherein the operation member includes a rotatably-driven cam member that rotates once or twice after circulation purge is started.

7. An ink jet recording device, comprising:

a print head including:

a nozzle surface formed with a plurality of nozzles; and a plurality of actuators for ejecting ink from the plurality of nozzles to perform printing operations;

a circulation channel including:

a manifold in fluid communication with the plurality of actuators;

an ink tank containing ink;

a supply channel that supplies ink from the ink tank to the manifold; and a collection channel that supplies ink from the manifold to the ink tank;

an ink circulation unit that performs circulation purge to remove bubbles from the circulation channel by circulating ink through the circulation channel;

a capping unit that has a cap for covering the nozzle surface of the print head;

a purge control unit that operates the circulation unit to perform circulation purge and that, during circulation purge, operates the capping unit to cover the nozzle surface with the cap to form a closed space between the nozzle surface and the cap, and a suction purge unit connected to the cap, and controlled by the purge control unit to perform suction purge during circulation purge, for suction of ink from the print head through the cap, the purge control unit controlling the suction.

8. An ink jet recording device as claimed claim 7, wherein the purge control unit controls the suction purge unit to perform suction purge during circulation purge for a set time duration shorter than circulation purge.

9. An ink jet recording device as claimed in claim 8, wherein the purge control unit controls the suction purge unit to perform suction purge from start of circulation purge.

10. An ink jet recording device as claimed in claim 7, wherein the purge control unit, during circulation purge, first operates the capping unit to form a closed space between the nozzle surface and the cap, and then operates the suction purge unit to perform suction purge.

11. An ink jet recording device as claimed in claim 7, wherein the cap is in fluid communication with an ink discharge channel, and further comprising an opening/closing unit interlocked with the cap, the opening/closing unit closing the ink discharge channel when the closed space is formed between the nozzle surface and the cap.

12. An ink jet recording device as claimed in claim 7, wherein the capping unit covers the nozzle surface with the cap during non-printing periods to prevent ink in the nozzles from drying out.

13. An ink jet recording device, comprising:

a print head including:

a nozzle surface formed with a plurality of nozzles; and a plurality of actuators for ejecting ink from the plurality of nozzles to perform printing operations;

a circulation channel including:

a manifold in fluid communication with the plurality of actuators;

an ink tank containing ink;

a supply channel that supplies ink from the ink tank to the manifold; and a collection channel that supplies ink from the manifold to the ink tank;

an ink circulation unit that performs circulation purge to remove bubbles from the circulation channel by circulating ink through the circulation channel;

a valve unit provided along the collection channel, for opening the collection channel during circulation purge and closing the collection channel during printing;

a purge control unit for controlling the valve unit to restrict flow in the collection channel either before or after circulation purge and, while controlling the valve unit, driving the ink circulation unit for a set duration of time to perform supplemental purge; and a capping unit having a cap, the purge control unit, during supplemental purge, driving the capping unit to position the cap and nozzle surface in confrontation with each other, wherein the capping unit further has a pump for sucking ink from the cap, the purge control unit driving both the pump and the ink circulation unit during the supplemental purge.

14. An ink jet recording device as claimed in claim 13, wherein the valve unit includes an open/close valve that closes the collection channel during supplemental purge.

15. An ink jet recording device as claimed in claim 13, herein, the capping unit further has a pump for sucking ink from the cap, the purge control unit driving the pump after driving the ink circulation unit for the supplemental purge.

16. An ink jet recording device as claimed in claim 13, wherein the capping unit covers the nozzle surface with the cap during non-printing periods to prevent ink in the nozzles from drying out.

17. An ink jet recording device, comprising:

a print head having a plurality of actuators for ejecting ink from the plurality of nozzles to perform printing operations;

a circulation channel including:

a manifold in fluid communication with the plurality of actuators;

an ink tank containing ink;

a supply channel that supplies ink from the ink tank to the manifold; and a collection channel that returns ink from the manifold to the ink tank;

an ink circulation unit that performs circulation purge to remove bubbles from the circulation channel by circulating ink through the circulation channel; and a valve unit provided along the collection channel, for partially restricting flow in the collection channel during circulation purge and for closing the collection channel during printing.

* * * * *